US009955781B2

(12) United States Patent
Andersson

(10) Patent No.: US 9,955,781 B2
(45) Date of Patent: May 1, 2018

(54) FURNITURE MODULE

(71) Applicant: IKEA SUPPLY AG, Pratteln (CH)

(72) Inventor: Benny Andersson, Älmhult (SE)

(73) Assignee: IKEA SUPPLY AG, Pratteln (CH)

( * ) Notice: Subject to any disclaimer, the term of this patent is extended or adjusted under 35 U.S.C. 154(b) by 123 days.

(21) Appl. No.: 14/912,454

(22) PCT Filed: Aug. 30, 2013

(86) PCT No.: PCT/EP2013/068000
§ 371 (c)(1),
(2) Date: Feb. 17, 2016

(87) PCT Pub. No.: WO2015/028084
PCT Pub. Date: Mar. 5, 2015

(65) Prior Publication Data

US 2016/0192775 A1 Jul. 7, 2016

(51) Int. Cl.
*A47B 43/00* (2006.01)
*A47B 47/00* (2006.01)
(Continued)

(52) U.S. Cl.
CPC ..... *A47B 47/0091* (2013.01); *A47B 47/0075* (2013.01); *A47B 47/042* (2013.01);
(Continued)

(58) Field of Classification Search
CPC ..... A47B 87/02
(Continued)

(56) References Cited

U.S. PATENT DOCUMENTS 3,301,622 A * 1/1967 Dasovic ..... A47B 47/04 312/111
5,582,306 A * 12/1996 Balter ..... A47B 61/00 211/105.1
(Continued)

FOREIGN PATENT DOCUMENTS

DE 2952381 A1 7/1981
EP 790361 * 8/1997
(Continued)

OTHER PUBLICATIONS

Translation of EP790361, generated Aug. 11, 2017.*
(Continued)

*Primary Examiner* — Matthew W Ing
(74) *Attorney, Agent, or Firm* — Merchant & Gould P.C.

(57) ABSTRACT

A furniture module can include a cupboard, book shelf, chests of drawers and like furniture. The module (1) is formed of two opposite sides (2, 3) and a top (5) and bottom (4) placed at opposite ends of the sides (2, 3), forming a frame. At least two columns of mounting openings (6, 7, 8, 9) are placed on the inside of the sides (2, 3) for attaching shelves, drawers, doors etc. The mounting openings (6, 7, 8, 9) of each column are placed at even spacing, giving an equal distance (M) between adjacent mounting openings (6, 7, 8, 9). The distance between the uppermost mounting opening (6, 7, 8, 9) in each column of mounting openings and the upper side of the module (1) is one and a half (M+½M) of the distance between adjacent mounting openings (6, 7, 8, 9). Also the distance between the lowermost mounting hole in the column of mounting holes and the lower side of the module (1) is one and a half (M+½M) of the distance between adjacent mounting openings (6, 7, 8, 9).

16 Claims, 3 Drawing Sheets

(51) Int. Cl.
*A47B 47/04* (2006.01)
*A47B 96/20* (2006.01)

(52) U.S. Cl.
CPC ..... *A47B 96/20* (2013.01); *A47B 96/205* (2013.01); *A47B 2220/0058* (2013.01)

(58) Field of Classification Search
USPC ..... 312/107, 109, 257.1, 326, 329; 108/107, 108/147.11, 147.15, 147.16
See application file for complete search history.

(56) References Cited

U.S. PATENT DOCUMENTS 5,902,025 A * 5/1999 Yu ..... G06F 1/181 312/109
6,648,431 B1 * 11/2003 King ..... E05D 5/046 16/382
7,083,056 B2 * 8/2006 Routhier ..... A47B 95/008 211/190
2006/0250052 A1 * 11/2006 Davis ..... A47B 47/042 312/107

FOREIGN PATENT DOCUMENTS

| | | | |
|---|---|---|---|
| EP | 2371240 | A1 | 10/2011 |
| FR | 2329231 | A2 | 5/1977 |
| JP | 2012-161389 | A | 8/2012 |
| RU | 2337599 | C2 | 11/2008 |
| WO | WO 92/06620 | A1 | 4/1992 |

OTHER PUBLICATIONS

International Search Report for International Application No. PCT/EP2013/068000 dated Apr. 10, 2014 (3 pages).
Office Action for Russian Patent Application No. 2016102378/12(003413) dated Jun. 13, 2017.

* cited by examiner

FURNITURE MODULE

This application is a National Stage Application of PCT/EP2013/068000, filed 30 Aug. 2013, which application is incorporated herein by reference. To the extent appropriate, a claim of priority is made to the above disclosed application.

TECHNICAL FIELD

The present invention is directed to a module or carcass for furniture, such as cupboards, shelves or chests of drawers.

BACKGROUND

The present invention is intended for furniture, kitchen cupboards etc. based on a furniture module, which furniture module has two vertical boards held together by two horizontal boards at respective ends of the vertical boards. Thus, the boards will form a module or carcass in the form of a rectangular frame. The modules could be placed side-by-side and/or on top of each other to form a larger unit. Normally, the modules are furnished with a back part. On the front of the modules doors may be placed. On the inside of the vertical boards, that is the sides facing each other, columns or vertical rows of openings are provided. Said openings are to receive fastening means for shelves, drawers, hinges etc.

For drilling a large number of holes in rows it is common to place a number of drills in some kind of frame. Thereby, a row of holes may be drilled simultaneously. It is today common to use a distance of 32 mm between the holes in respective row of openings of a cupboard etc. The distance of 32 mm is said to be due to the fact that when placing several drills close to one another it was once the minimal distance possible, depending on possible minimal sizes of gears for driving etc. For instance hinges used today are often adapted to the "standardized" distance of 32 mm. Therefore, openings of column of openings are normally separated by said distance of 32 mm.

The positions of the openings dictate the possible placements of fastening means for shelves, drawers, doors etc of furniture.

In order to facilitate for costumers to design furniture such as cupboards, shelves, etc. according to their specific needs and wishes, it is beneficial if different parts may be combined freely. It should function with drawers irrespectively if they have outer or inner fronts and with doors irrespectively if they have an inside or outside placement. A further advantage is to choose the outer dimensions of different furniture modules in a way that are easy to add up. To achieve this, it is important to match the distance between openings in columns of openings to the thickness of shelves to be received inside the modules, the height of fronts of drawers and the outer dimension of the modules.

If the dimensions of modules or carcasses placed on top of each other or side by side, is not even (a 00-dimension) the outer dimension of the total piece of furniture will also be uneven, making it harder to adapt other parts, such as doors or top shelves placed on several modules. The difficulty often lies in calculating uneven numbers. In the existing systems it is fairly common to have to add pieces of different sizes, in order to be able to have free placing and adaptation of shelves etc.

It is also beneficial when developing new pieces of furniture, and/or new parts to be received inside the furniture that fixed dimensions are chosen wisely. The person developing for instance a new drawer for a specific purpose will easily calculate the available volumes for such a new drawer.

SUMMARY

One idea of the present invention is to be able to use standardized drawers, doors, shelves etc. independently of the size of the module or carcass forming the frame of a cupboard etc. This will facilitate production and storing and will give a flexible system for forming different cupboards.

In view of economy it is beneficial to have standardized modules that can be combined in different ways depending on the final piece of furniture to be formed. The modules may be placed on top of each other and/or side-by-side to form furniture of different sizes and designs.

It is also beneficial if drawers, shelves etc. can be used irrespectively of the type of furniture to be used. Thus, it does not matter whether it is a kitchen cupboard, a book shelf, a chest of drawers etc.

The adaptation of for instance drawers is normally made in a way to give suitable spacing between the fronts of drawers, irrespectively if the drawers have outside fronts or inside fronts. Inside fronts are placed inside the side boards and top and bottom plates of the module when the drawers are inserted all the way. Outside fronts are received on the side boards and top and bottom plates of the module when the drawers are inserted all the way. Thus, the fronts will abut the front of a module when using drawers with outside fronts. Also possible doors may be inside or outside in a way corresponding with the inside and outside, respectively, fronts of drawers.

In the modules of the present invention, at least one column of mounting holes is placed at a forward and rear edge, respectively, of each side board. There may also be further columns of mounting holes between the columns of mounting holes at the forward and rear edges. The mounting holes of each column are placed one above the other with an even spacing.

One important feature of the module formed is that the distances of the mounting holes should be such that it is possible for instance to have fronts of drawers, which fronts have the same size. There is a certain thickness needed for the top plate and bottom plate, respectively, in order for the plates not to bend or sag too much. Based on this and the wish to have modules with the possibility to receive fronts of drawers with even spacing and not with diverging dimensions of the top and bottom drawers, suitable dimensions are chosen. The dimensions chosen should also be easy to add up, in order to easily calculate the dimensions of furniture comprising several modules.

The material used for the top plate, bottom plate and shelves is of importance in view of dimensions possible to use in order to prevent sagging. The material used will also influence the weight of the furniture. The lower the weight of the material is, the easier it is to handle also for the final user. The present invention is primarily based on the idea of using a light-weight material (<350 kg/m$^3$), such as different kinds of board with a honeycomb core or a fibre board. As used in this description lightweight materials are below 350 kg/m$^3$.

Often a second column of openings are placed a short distance inside the column of mounting openings at the front of each side board. In an example the second column of openings are placed under a cover, for instance in the form of a surface sheet. By placing the openings of the second column under a cover the openings not used will not be visible. The second column of openings is needed to be able to place for instance hinges with a horizontal orientation. It is also often more easy to make the openings in a production plant, compared to making openings at assembly of a piece of furniture. Hinges for possible doors may be fixed to the side board by means of the lowermost openings of the column of openings closest to the front and the second column of openings. Thus, the hinges can be said to have a horizontal orientation in stead of a commonly used vertical orientation.

By having standardized dimensions chosen wisely it is possible to use the same standardized drawers, shelves, doors etc. independently in which type of furniture said parts are placed.

Further objects and advantages of the present invention will be obvious for a person skilled in the art reading the detailed description below.

BRIEF DESCRIPTION OF THE DRAWINGS

The invention will be described further below by way of an example and with reference to the enclosed drawings. In the drawings.

DETAILED DESCRIPTION

Figure 1:
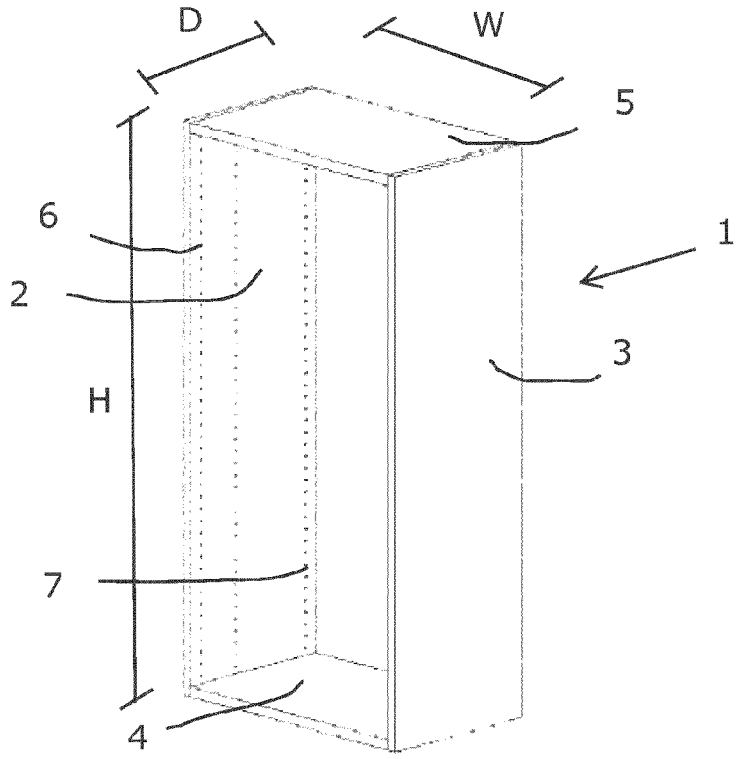
FIG. 1 is a perspective view of a module according to the present invention.
Figure 2:
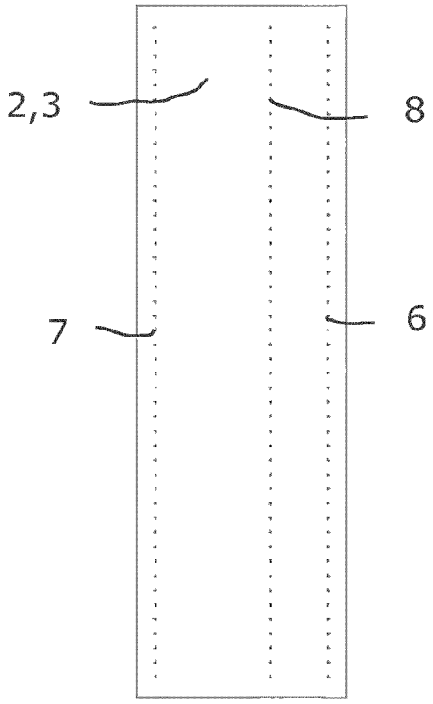
FIG. 2 is a front view of a side of the module of FIG. 1.

A base element of the present invention is a module 1 or carcass, which may be used for different cupboards, shelves, wardrobes etc. The module 1 is formed of two vertical boards and two horizontal boards, forming two sides 2, 3, a bottom 4 and a top 5, respectively. The sides 2, 3 are placed opposite each other and the bottom 4 and top 5 are placed at opposite ends of the sides 2, 3, whereby a rectangular frame is formed. Normally the module 1 is provided with a back (not shown) when forming a cupboard etc. On the inside of respective side 2, 3 of the module 1 at least two vertical columns of mounting openings 6, 7 are provided. Which at least two vertical columns of mounting openings are placed adjacent opposite vertical edges of respective side 2, 3. The mounting openings are to receive means for attaching shelves, rails for drawers, hinges for doors etc. In the shown embodiment there is a further vertical column of mounting openings 8, which further column is placed at a desired distance from one of the column mounting openings 7 at a vertical edge of a side 2, 3 of the module 1. The further vertical column of openings 8 are also used for means for attaching different parts. Depending on the depth of the module still further vertical columns of openings may be provided.

The mounting openings are often circular, but any suitable shape of mounting openings may be used.

Even though three columns of openings 6, 7, 8 are shown in FIG. 1 a person skilled in the art realizes that any number of columns of openings may be provided. The number of columns of openings provided is often correlated to the depth of the formed module 1. The greater the depth D the more columns may be needed to securely mount shelves etc.

In FIG. 1 the height, H, the width, W, and depth, D of the module as defined and used in this description are indicated.

Figure 3:
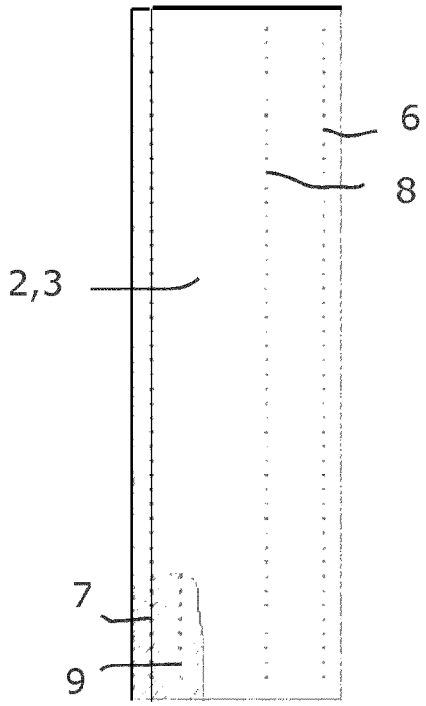
FIG. 3 is a front view of an alternative embodiment of a side of the module of FIG. 1.

According to one embodiment a further column of openings 9 are placed a short distance inside one of the column of openings 7 at the edge of the side 2, 3, as indicated in FIG. 3. The openings 7, 9 of the adjacent columns of openings are placed on the same height and may be used for example for a horizontal mounting of hinges for doors. The further column of openings 9 may be placed under a cover, for instance formed of a surface sheet of a lightweight board.

Figure 4:
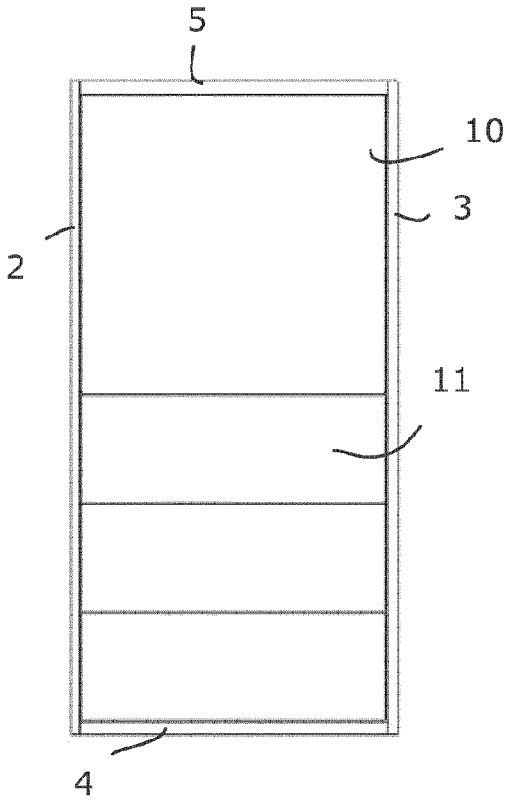
FIG. 4 is a front view of an example of a cupboard, in which the module of FIG. 1 has received a number of drawers having inside fronts.

In FIG. 4 an example of a cupboard is shown, which cupboard has drawers with inside fronts 10, 11. By inside fronts, as used herein, is meant that in the closed state of the drawers the inside fronts 10, 11 will be placed inside the module 1. Thus, the front sides of the fronts 10, 11 will be approximately flush with the front sides of the sides 2, 3, bottom 4 and top 1 of the module 1.

Figure 5:
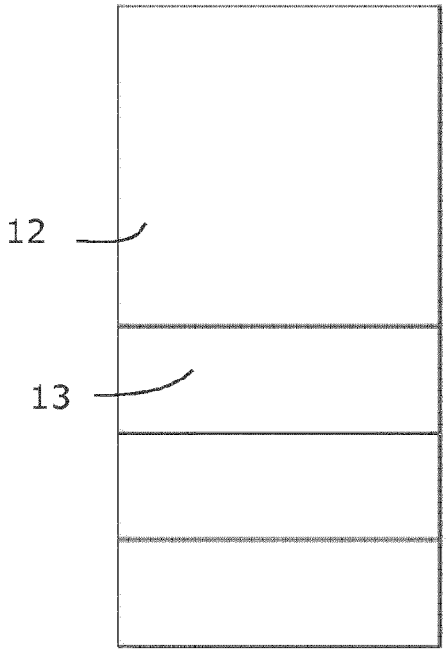
FIG. 5 is a front view of a further example of a cupboard, in which the module of FIG. 1 has received a number of drawers having outside fronts.

FIG. 5 shows an example of a cupboard having drawers with outside fronts 12, 13. By outside fronts, as used herein, is meant that in the closed state of the drawers the outside fronts 12, 13 will abut the sides 2, 3 of the module 1.

In order to be able to place drawers with either outside fronts 12, 13 or with inside fronts 10, 11 in the same module, the outside fronts 12, 13 will have a somewhat larger width and somewhat larger height than the inside fronts 10, 11.

Figure 6:
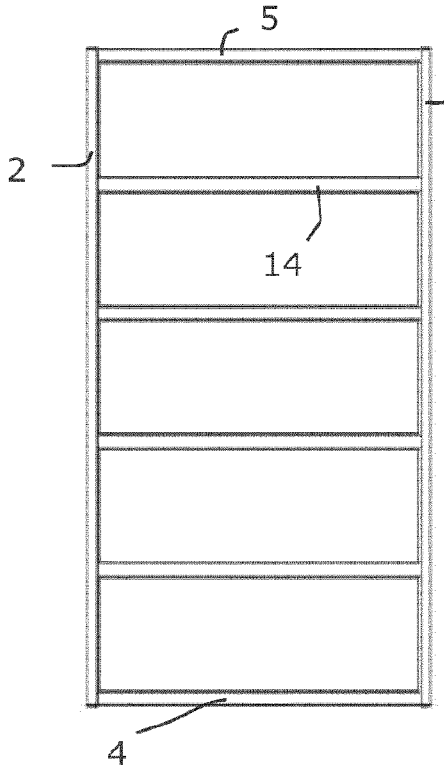
FIG. 6 is a front view of an example of a module of the present invention having a number of shelves.

In FIG. 6 an example of a module 1 is shown furnished with a number of shelves 14, placed with an even spacing.

Figure 7:
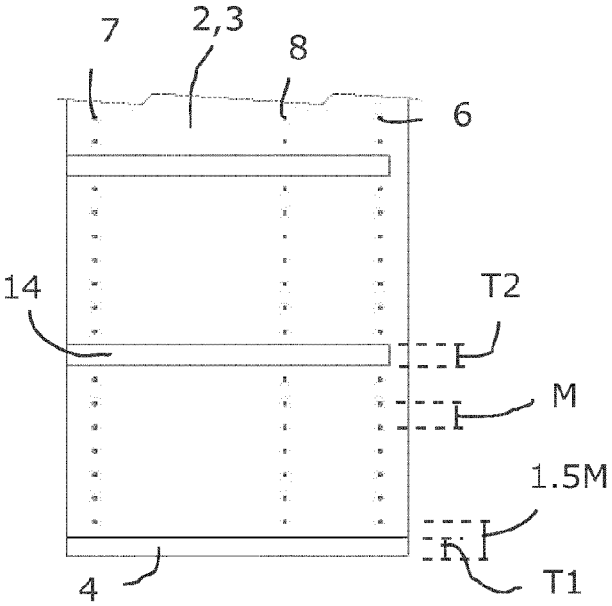
FIG. 7 is a detailed view of a part of a cupboard according to the present invention.

FIG. 7 is a detail view at the bottom of a side 2, 3 of a module 1. A bottom 4 of the module is shown as mounted to the side 2, 3 and also two shelves 14 are shown as mounted to the side 2, 3. A distance M between the openings 6, 7, 8 of each column of openings 6, 7, 8 is equal throughout the module. The distance between the openings 6, 7, 8 in each column of openings are equal and for ease of description only one column of openings 6 will be described below. A person skilled in the art realizes that the description apply for all columns of openings 6, 7, 8. The bottom 4 has a thickness T1 and each shelf 14 has a thickness T2. In this invention the thickness T1 of the bottom 4 is normally equal to the thickness T2 of the shelf 14. The distance between the lowermost opening of the column of openings 6 and the lower side of the bottom 4 is 1.5M. Also the distance between the uppermost opening of the column of openings 6 and the upper side of the top 5 is 1.5M. Normally both T1 and T2 is smaller than M. The spacing M is measured from centre to centre of the mounting holes, thus, it is a centre distance.

By choosing the distance M and the thicknesses T1 and T2 wisely a system is formed that is easy to scale up and down, without the need to adapt any parts received inside the one or more modules 1 in the system formed. Thus, for example standardized drawers may be placed in any module 1. If two or more modules 1 are placed on top of each other, a column of openings 6 will be formed going over from one module 1 into the next module 1. The distance between an uppermost opening of a lower module 1 to a lowermost opening of a module 1 placed on top of the lower module will be 3M.

Figure 8:
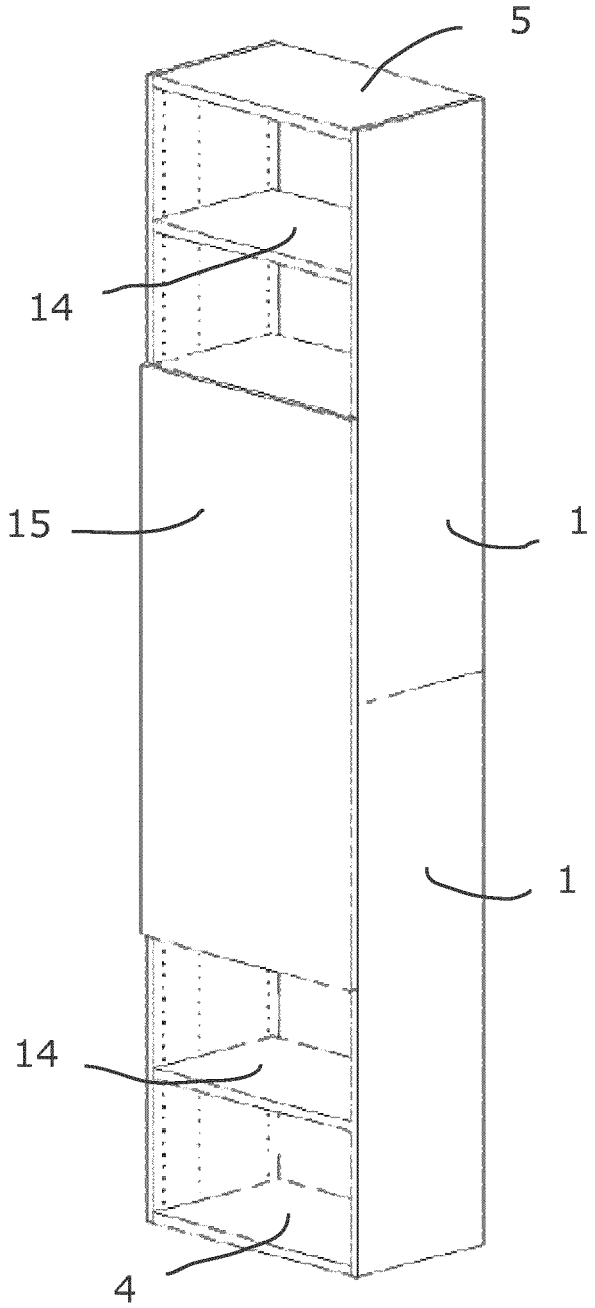
FIG. 8 is a perspective view of an example of a cupboard formed of two modules placed on top of each other.
Figure 9:
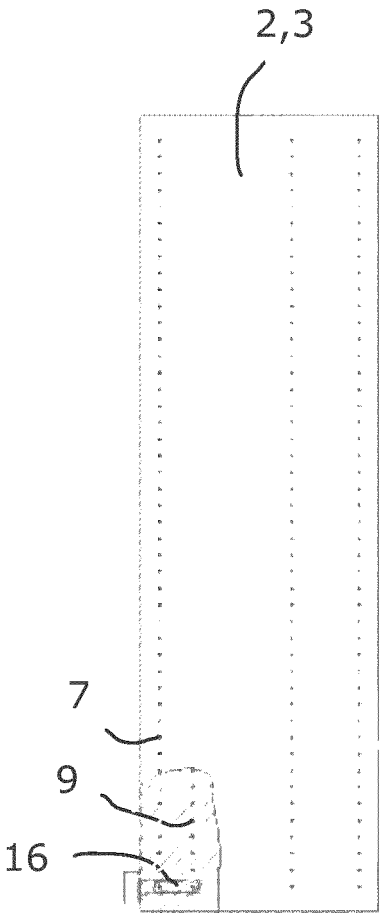
FIG. 9 is a front view illustrating a horizontally placed hinge.

In FIG. 8 one example is given of a cupboard, formed of a module 1 placed on top of another module 1. A door 15 is placed across the two modules 1. Thus, the door 15 is attached to both the shown modules 1. A shelf 14 is also shown in each of the two modules 1. In FIG. 9 a hinge 16 is indicated, which hinge 16 is mounted in a horizontal position on a side 2, 3 of the module 1. The hinge is mounted in one opening 7, in a column of openings at the edge of the side 2, and in opening 9 in the adjacent column of openings 9, which column of openings normally is covered. By the mounting of the hinge 16 a hole is only made in the sheet covering the openings 9 of the column of openings, leaving not used openings still covered. Placing the hinges 16 horizontally the available space between the hinges 16 will be increase compared to a vertical placing of the hinges. Thus, the horizontal placing of the hinges 16 will normally feel less in the way for the user.

By placing modules side by side and/or on top of each other furniture of different forms and sizes may be created.

By choosing a thickness T1 of 22 mm for the bottom 4 and top 5 and a thickness T2 of 22 mm for possible shelves 14 and by choosing the distance M to 25 mm, a system is formed that relatively easy can be scaled upwards or downwards depending on wish. The chosen dimension of 22 mm is relatively small but still big enough for the top, bottom and shelves 14 to withstand sagging. The height of each module can then be chosen after will as a multiple of M, which in this example is 25 mm. The thickness of 22 mm of the top and bottom plate and M=25 mm give the advantages discussed above regarding having standardized modules.

The invention is developed basically for so called lightweight materials. As used in this description lightweight materials have a weight of less than 350 kg/m$^3$. The lightweight materials are normally some kind of board material having boards placed on opposite sides of a core or a fiber board. The core may have a honeycomb form. A shelf 8 having a thickness T2=22 mm will normally be strong enough for use in a cupboard.

By using modules 1 wherein M=25 mm, a system is formed, which is flexible and easy for users to adapt to different situations. The modules 1 may have heights with an even number and example of heights formed are 400 mm, 600 mm, 800 mm, 1200 mm, 1800 mm and 2000 mm. One column of mounting holes 7 are placed at a distance of 30 mm to the outer face of the adjacent side. By choosing the different dimensions wisely, as indicated above, it will for instance be possible to place shelves 14 with equal spacing in such a way that uniform volumes will be formed between the shelves 14. Said uniform volume will also be formed between the bottom 4 and an adjacent shelf 14, as well as between the top 5 and an adjacent shelf 14.

Depending on the depth D of the modules 1 each side 2, 3 may have several columns of openings 6, 7, 8. The distances between the columns of openings will be affected by the depth D of respective module 1. Each side 2, 3 of each module 1 has at least two columns of openings 6, 7 placed at opposite sides. In some cases the depth of the module 1 is such that drawers, shelves etc. may be arranged on opposite sides of the module 1.

For drawers having outside fronts 12, 13 the fronts are placed with a play of 3 mm above each other, in the above example of measurements. The outside fronts 12, 13 are placed 1.5 mm inside the outer edge of respective side 2, 3 of the module 1. For drawers having inside fronts 10, 11 the fronts are placed with a play of 3 mm above each other in said example of measurements. The play between respective front and the lower side of the top and the upper side of the bottom is 3.5 mm, to compensate for possible sagging. The inside fronts 10, 11 are also placed with a play of 3 mm to the inner side of respective side 2, 3. Thereby examples of heights for inside fronts 10, 11 are 97 mm, 147 mm, 197 mm, 247 mm, 297 mm, 347 mm and 397 mm. Examples of heights for outside fronts 11, 12 are 122 mm, 172 mm, 222 mm, 272 mm, 322 mm and 372 mm.

In the same way as for the fronts 10-13, possible doors 15 may be inside doors or outside doors. The inside doors are placed with a play corresponding with the inside fronts 10, 11 of drawers. The outside doors 15 are placed at the module in a corresponding way as for the outside fronts 12, 13 of drawers.

Also in the direction of depth D of each module 1 it is beneficial to place the columns of mounting holes 6, 7, 8 at specific distances. In one example columns of mounting holes 6, 7 are placed at a distance of 200 mm. If the distance between the outer face of each side and an adjacent column of mounting holes is 30 mm, it means that the module 1 has to have a depth of at least 260 mm to be able to give a distance of 200 mm between columns of mounting holes.

One positive effect of choosing the measurements wisely, as indicated above, is that when developing new parts to be received in the modules 1 the different available volumes will be known.

The invention claimed is:

1. A furniture module of a cupboard, book shelf, or chests of drawers the furniture module is formed of two opposite sides and a top and bottom placed at opposite ends of the sides, wherein the module forms a frame, wherein at least two columns of mounting openings are placed on the inside of the sides for attaching shelves, drawers, or doors, wherein the mounting openings of each column is placed at equal distance (M), that the distance between the uppermost mounting opening in each column of mounting openings and the upper side of the module is one and a half (M+½M) of the distance between adjacent mounting openings and that the distance between the lowermost mounting hole in the column of mounting holes and the lower side of the module is one and a half (M+½M) of the distance between adjacent mounting openings.

2. The furniture module of claim 1, wherein the thickness (T1) of the top and bottom is the same as the thickness (T2) of shelves mounted inside the module.

3. The furniture module of claim 2, wherein the distance (M) between the mounting openings of each column of mounting openings is 25 mm, wherein the thickness (T1) of the top and bottom is 22 mm, and wherein the thickness (T2) of the shelves is 22 mm.

4. The furniture module of claim 1, wherein one column of mounting openings is placed at each free edge of each side.

5. The furniture module of claim 4, wherein the columns of mounting openings at respective free edge of each side is placed 30 mm from the free edge.

6. The furniture module of claim 4, wherein a further column of mounting openings is placed adjacent and inside at least one of the columns of mounting openings placed at respective free edge of the sides.

7. The furniture module of claim 6, wherein said further column of mounting openings, placed adjacent at least one of the columns of mounting openings placed at the free edges of the sides, is covered by a surface sheet.

8. The furniture module of claim 6, wherein a hinge for a door is mounted both in said further column of mounting openings, placed adjacent one of the columns of mounting openings placed at a free edge of a side, and the column of mounting openings placed at a free edge of a side.

9. The furniture module of claim 1, wherein the furniture module receives one or more drawers having outside fronts, whereby the outside fronts are placed 1.5 mm inside the outer edge of respective side of the module and with a play of 3 mm between each other if several drawers are received.

10. The furniture module of claim 1, wherein the furniture module receives one or more drawers having inside fronts, whereby the inside fronts are placed with a play of 3 mm to respective side of the module, with a play of 3.5 mm to an adjacent top or bottom and with a play of 3 mm between each other if several drawers are received.

11. The furniture module of claim 1, wherein the module, drawers, shelves, and doors are made of a board material having a weight of less than 350 kg/$m^3$.

12. The furniture module of claim 11, wherein the board material has a honeycomb core.

13. A piece of furniture formed of two or more furniture modules of claim 1, wherein the two or more furniture modules are placed side-by-side or on top of each other.

14. The piece of furniture of claim 13, wherein at least two modules are placed on top of each other and wherein a door is mounted partly in each of the two modules placed on top of each other.

15. The furniture module of claim 1, wherein the furniture module receives one or more outside doors placed 5 mm inside the outer edge of respective side of the module and with a play of 3 mm between each other if several doors are received.

16. The furniture module of claim 1, wherein the furniture module receives one or more inside doors placed with a play of 3 mm to respective side of the module, with a play of 3.5 mm to a possible adjacent top or bottom and with a play of 3 mm between each other if several doors are received.

* * * * *